US008500041B2

(12) United States Patent
Wu

(10) Patent No.: US 8,500,041 B2
(45) Date of Patent: Aug. 6, 2013

(54) PORTABLE DIRECT-CURRENT SPRAYER

(76) Inventor: Scott Wu, Wu Feng Hsiang (TW)

( * ) Notice: Subject to any disclaimer, the term of this patent is extended or adjusted under 35 U.S.C. 154(b) by 1521 days.

(21) Appl. No.: 11/164,346

(22) Filed: Nov. 18, 2005

(65) Prior Publication Data

US 2007/0114302 A1 May 24, 2007

(51) Int. Cl.
*B05B 9/00* (2006.01)

(52) U.S. Cl.
USPC ..... 239/149; 239/146; 239/332; 239/333; 239/375; 222/333; 134/173

(58) Field of Classification Search
USPC ..... 239/302, 331, 332, 325, 333, 375, 239/146, 149, 175, 154; 222/333; 15/319, 15/320, 321; 134/172, 173, 95.3
See application file for complete search history.

(56) References Cited

U.S. PATENT DOCUMENTS

| | | | | |
|---|---|---|---|---|
| 4,172,796 | A | 10/1979 | Corder | |
| 4,379,053 | A | 4/1983 | Brane | |
| RE32,144 | E | 5/1986 | Keefer | |
| 4,925,105 | A * | 5/1990 | Lin | 239/154 |
| 5,029,758 | A * | 7/1991 | Chayer | 239/172 |
| 5,110,468 | A | 5/1992 | Miyashita et al. | |
| 5,628,895 | A | 5/1997 | Zucholl | |
| 5,632,892 | A | 5/1997 | Klein | |
| 5,890,258 | A * | 4/1999 | Lee | 15/320 |
| 6,158,669 | A * | 12/2000 | Louis | 239/146 |
| 6,243,913 | B1 * | 6/2001 | Frank et al. | 15/320 |
| 6,446,881 | B1 * | 9/2002 | You | 239/146 |
| 6,855,897 | B1 | 2/2005 | Dorward | |
| 6,880,191 | B2 * | 4/2005 | Bristor | 8/148 |
| 7,118,050 | B1 * | 10/2006 | Chen | 239/328 |
| 2004/0104153 | A1 | 6/2004 | Yang | |
| 2005/0006400 | A1 * | 1/2005 | Shapanus et al. | 222/1 |
| 2008/0011657 | A1 | 1/2008 | Chen | |

* cited by examiner

*Primary Examiner* — Dinh Q Nguyen
(74) *Attorney, Agent, or Firm* — Alan Kamrath; Kamrath IP Lawfirm, P.A.

(57) ABSTRACT

A portable direct-circuit sprayer includes a body. The body includes a water chamber therein for containing water, a component chamber therein and with two open sides, and an integrated floor between two portions of the water chamber between which the component chamber is positioned. A pump is installed in the component chamber in order to pressurize the water from the water chamber. A panel shuts one of the open sides of the component chamber. A cover shuts the other open side of the component chamber.

20 Claims, 7 Drawing Sheets

A-A

PORTABLE DIRECT-CURRENT SPRAYER

BACKGROUND OF INVENTION

1. Field of Invention

The present invention relates to a sprayer and, more particularly, to a portable direct-current sprayer.

2. Related Prior Art

In U.S. Pat. No. 6,158,669, there is disclosed a portable misting device 100 including a housing 102 and a compartment 119 put in the housing 102. The compartment 119 is shut by a sidewall 137. A bracket 123 is secured to the sidewall 137 by screws. A battery 128 is put on the bracket 123. A filter 110 and a pump 114 are attached to a side of the bracket 123 while an accumulator 116 is attached to an opposite side of the bracket 123. A hose 108 is inserted through an orifice 141 defined in the sidewall 137. A switch 131 is put in an orifice 143 defined in the sidewall 137. A switch 170 is put in an orifice 145 defined in the sidewall 137. The misting device 100 can be used in various occasions.

Several problems have been encountered in the use of the portable misting device 100. For maintenance or repair, the sidewall 137 must be moved from the housing 102. However, carrying the filter 110, the pump 114 and the accumulator 116, the sidewall 137 is heavy, and it is hard to handle the sidewall 137. Moreover, the housing 102 is weak for not using any integrated element between two portions thereof of the housing 102 between which the compartment 119 is defined.

The present invention is therefore intended to obviate or at least alleviate the problems encountered in the prior art.

SUMMARY OF INVENTION

According to the present invention, a portable direct-circuit sprayer includes is provided including a body. The body includes a water chamber therein for containing water, a component chamber therein with two open sides, and an integrated floor between two portions of the water chamber between which the component chamber is positioned. A pump is installed in the component chamber in order to pressurize the water from the water chamber. A panel shuts one of the open sides of the component chamber. A cover shuts the other open side of the component chamber.

An advantage of the sprayer according to the present invention is its strength. This is due to the use of the floor connecting the portions of the water chamber. When subject to the weight of the pump, or when subject to the pressure caused by the pump, the body will sustain its shape, thus minimizing the possibility of cracking and bursting.

Another advantage of the sprayer according to the present invention is its easy maintenance and repair. This is because the component chamber can be opened from the open sides Other advantages and novel features of the present invention will become apparent from the following detailed description referring to the attached drawings.

BRIEF DESCRIPTION OF DRAWINGS

The present invention will be described through detailed illustration of two embodiments referring to the drawings.

DETAILED DESCRIPTION OF INVENTION

Figure 1:
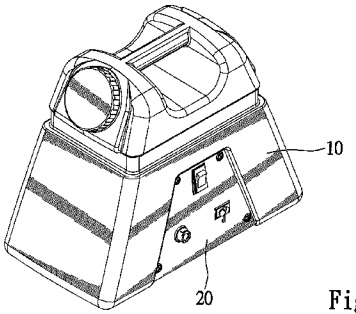
FIG. 1 is a perspective view of a portable direct-current sprayer according to the first embodiment of the present invention.
Figure 2:
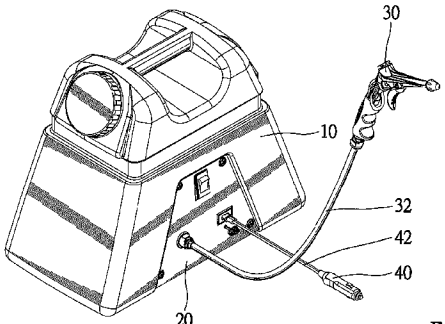
FIG. 2 is a perspective view of a hose and a cable connected to the portable direct-current sprayer shown in FIG. 1.

Referring to FIGS. 1 and 2, a portable direct-current sprayer is shown in accordance with a first embodiment of the present invention. The sprayer includes a body 10, a panel 20, a hose 32 connected to the panel 20, a nozzle 30 connected to the hose 32, a cable 42 connected to the panel 20 and a plug 40 connected to the cable 42.

Figure 3:
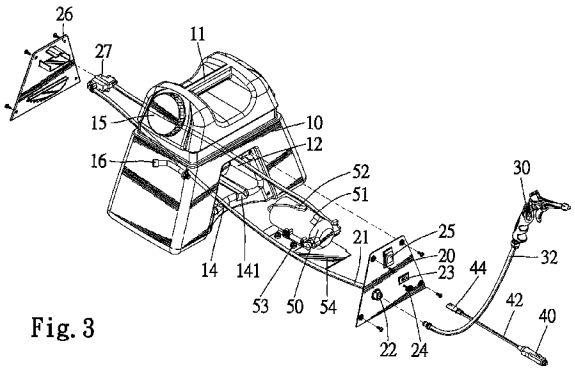
FIG. 3 is an exploded view of the sprayer shown in FIG. 2.
Figure 4:
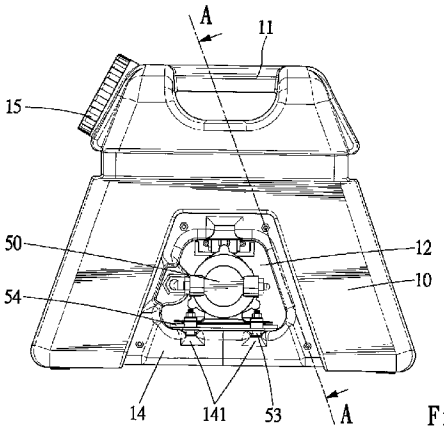
FIG. 4 is a front view of the sprayer shown in FIG. 1 from which a cover is detached in order to show a pump.
Figure 5:
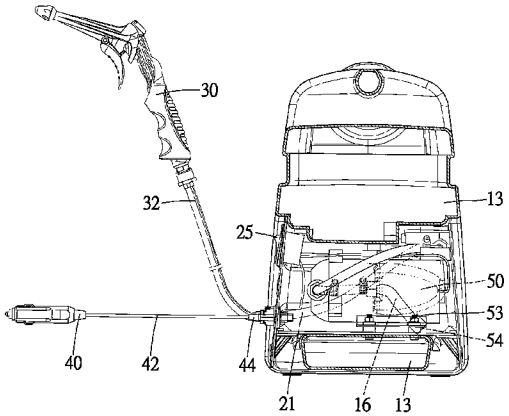
FIG. 5 is a cross-sectional view taken along a line A-A in FIG. 4.

Referring to FIGS. 3 through 5, the body 10 includes a handle 11 for facilitating the handling of the sprayer. The body 10 defines a water chamber 13 (FIG. 5). The water chamber 13 includes an opening (not shown) near the handle 11. Water can be fed into the water chamber 13 through the opening. The opening can be shut by a cap 15 so that the water can be kept in the water chamber 13.

The body 10 further defines a component chamber 12 separated from the water chamber 13, except for an inter-chamber pipe 16 directed to the component chamber 12 from the water chamber 13. Water can be transmitted to the component chamber 12 from the water chamber 13 through the inter-chamber pipe 16. The component chamber 12 is positioned between first and second portions of the water chamber 13, with the second portion separated from the first portion by the component chamber 12. The component chamber 12 includes first and second open sides, with the first open side opposite to the second open side.

Moreover, the body 10 includes an integrated floor 14 below the component chamber 12 and integrated between the first and second portions of the water chamber 13 as a single inseparable element. The integrated floor 14 extends between the first and second open sides of the component chamber 12. The integrated floor 14 enhances the rigidity of the body 10. Two grooves 141 are defined in the integrated floor 14. The water chamber 13 further includes an intermediate portion connecting the first and second portions and spaced from and opposite the integrated floor 14. Thus, the first, second and intermediate portions define substantially an inverted U-shape. Particularly, in the form shown, the body 10 defines cross-sections generally parallel to the first and second open sides of the component chamber which are generally A-shaped. The first, second and intermediate portions and the integrated floor 14 define the first and second open sides of the component chamber 12. Particularly, in the form shown, the component chamber 12 has cross-sections generally parallel to the first and second open sides which are isosceles trapezoid in shape.

In the component chamber 12, a pump 50 is installed that consumes direct current, not alternate current, in order to pump water. The pump 50 includes an inlet pipe 51 and an outlet pipe 52. The inlet pipe 51 is connected to the inter-chamber pipe 16. Water can be transmitted to the pump 50 from the water chamber 13 through the inlet pipe 51 and the inter-chamber pipe 16. The outlet pipe 52 is connected to a pressure regulator 27 that regulates the pressure at which the pump 50 pumps water. The pump 50 is secured to a platform 54 by a plurality of fasteners 53. The fasteners 53 can slide in the grooves 141 so that the motor 50 on the platform 54 can slide smoothly into and away from the component chamber 12 through either of the first and second open sides.

On the panel 20 are installed a joint 22, a socket 23, a dummy plug 24 and a switch 25 connected electrically to the socket 23. The joint 22 is connected to the pressure regulator 27 through a pipe 21. The hose 32 can be connected to the joint 22. The wire 42 includes another plug 44 that can be plugged in the socket 21. The pump 50 can be turned on and off through operating the switch 25. When the sprayer is not in use, the plug 44 can be pulled from the socket 23. Instead, the dummy plug 24 can be plugged in the socket 23 for the security of the sprayer and the safety of users. The dummy plug 24 can be replaced with a lid for covering the socket 23. The panel 20 is removably secured to the body 10 by a plurality of fasteners (not numbered).

A cover 26 is provided on which the pressure regulator 27 is installed. The cover 26 is removably secured to the body 10 by a plurality of fasteners (not numbered).

Figure 6:
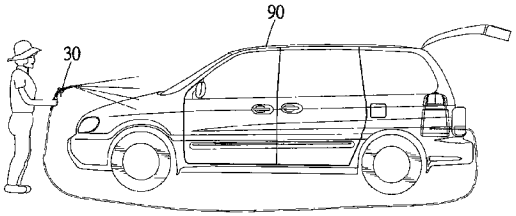
FIG. 6 is a side view of a vehicle washed with water sprayed from the sprayer shown in FIG. 2.

Referring to FIG. 6, a user washes a vehicle 90 with water sprayed from the nozzle 30. Although not shown, the plug 40 is plugged in a socket provided in the vehicle 90. After having a good time in the wild or on the beach, the user can have a shower with water sprayed from the nozzle 30. Thus, the user can keep the interior of the vehicle 90 clean.

Figure 7:
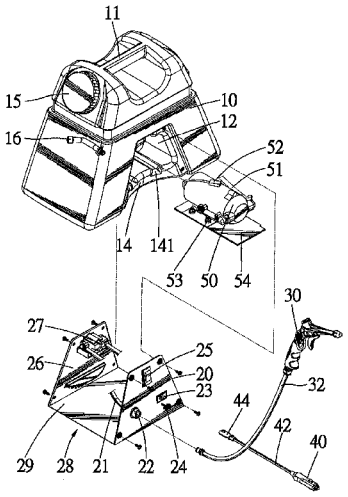
FIG. 7 is an exploded view of a portable direct-current sprayer according to the second embodiment of the present invention.

Referring to FIG. 7, there is shown a sprayer according to a second embodiment of the present invention. The second embodiment is like the first embodiment except using a covering device 28. The covering device 28 includes the panel 20, the cover 26 and a tray 29 formed between the panel 20 and the cover 26. The panel 20, the cover 26 and the tray 29 are integrated with one another and can be removed as a single element from the body 10.

The sprayer of the present invention exhibits several advantages.

Firstly, it is robust. This is due to the use of the integrated floor 14 integrally connecting the first and second portions of the water chamber 13. When subject to the weight of the pump 50, or when subject to the pressure caused by the pump 50, the body 10 will sustain its shape, thus minimizing the possibility of cracking and bursting.

Secondly, its maintenance and repair are easy for at least two reasons. Firstly, the component chamber 12 can be opened from and is accessible through the first and second open sides thanks to the use of the panel 20 and the cover 26. Secondly, the pump 50 can easily moved from the component chamber 12 through either the first and second open sides, because the fasteners 53 below the platform 54 can slide smoothly in and along the grooves 141 in the integrated floor 14.

The present invention has been described through the illustration of the preferred embodiment. Those skilled in the art can derive variations from the preferred embodiment without departing from the scope of the present invention. Therefore, the preferred embodiment shall not limit the scope of the present invention defined in the claims.

What is claimed is:

1. A portable direct-circuit sprayer comprising:

a body comprising a water chamber containing water, with the water chamber having a first portion and a second portion separated from the first portion, with the body further including a component chamber with first and second open sides, with the first open side opposite the second open side, with the body further including an integrated floor integrated to and extending between the first and second portions of the water chamber, with the water chamber having an intermediate portion connecting the first and second portions and spaced from and opposite the integrated floor, with the body including the first, second, and intermediate portions of the water chamber and the integrated floor being a single inseparable element, with the integrated floor extending between the first and second open sides, with the component chamber positioned between the first and second portions, with first and second portions and the integrated floor defining the first and second open sides, and with the component chamber accessible through the first and second open sides;

a pump installed in the component chamber and carried on the integrated floor, with the pump provided to pressurize the water from the water chamber;

a panel removably secured to the body and shutting the first open side of the component chamber; and a cover removably secured to the body and shutting the second open side of the component chamber.

2. The sprayer according to claim 1 further comprising a platform carrying the pump on the integrated floor in a sliding manner, with the platform slideable from the component chamber through either of the first and second open ends.

3. The sprayer according to claim 2 further comprising a plurality of fasteners securing the pump to the platform, wherein the integrated floor defines two grooves in and along which the plurality of fasteners securing the pump to the platform can slide.

4. The sprayer according to claim 1 wherein the body comprises a handle facilitating handling of the body.

5. The sprayer according to claim 1 further comprising a cap, with the water chamber having an opening, and with the cap shutting the opening of the water chamber, and with the first portion, the second portion and the intermediate portion defining substantially an inverted U-shape.

6. The sprayer according to claim 1 wherein the panel comprises a joint to which a hose can be connected.

7. The sprayer according to claim 1 wherein the panel comprises a socket in which a plug of a cable can be plugged.

8. The sprayer according to claim 7 wherein the panel further comprises a dummy plug that can be plugged in the socket when the sprayer is not in use.

9. The sprayer according to claim 1 further comprising a tray integrally formed between the panel and the cover, with the panel, the cover and the tray integrated with one another to form a covering device, with the covering device removable as a single element from the body.

10. The sprayer according to claim 9 further comprising a platform carrying the pump on the integrated floor in a sliding manner, with the platform slideable from the component chamber through either of the first and second open ends.

11. The sprayer according to claim 10 further comprising a plurality of fasteners securing the pump to the platform, wherein the integrated floor defines two grooves in and along which the plurality of fasteners securing the pump to the platform can slide.

12. The sprayer according to claim 9 wherein the body comprises a handle facilitating handling of the body.

13. The sprayer according to claim 9 further comprising a cap, with the water chamber having an opening, and with the cap shutting the opening of the water chamber, and with the first portion, the second portion and the intermediate portion defining substantially an inverted U-shape.

14. The sprayer according to claim 9 wherein the panel comprises a joint to which a hose can be connected.

15. The sprayer according to claim 9 wherein the panel comprises a socket in which a plug of a cable can be plugged.

16. The sprayer according to claim 15 wherein the panel further comprises a dummy plug that can be plugged in the socket when the sprayer is not in use.

17. The sprayer according to claim 1 wherein the component chamber has cross-sections generally parallel to the first and second open sides, with the cross-sections being isosceles trapezoidal in shape.

18. The sprayer according to claim 1 wherein the body defines cross-sections generally parallel to the first and second open sides, with the cross-sections being generally A-shaped.

19. The sprayer according to claim 9 wherein the component chamber has cross-sections generally parallel to the first and second open sides, with the cross-sections being isosceles trapezoidal in shape.

20. The sprayer according to claim 9 wherein the body defines cross-sections generally parallel to the first and second open sides, with the cross-sections being generally A-shaped.

* * * * *